US011471354B2

(12) United States Patent
Konsin et al.

(10) Patent No.: US 11,471,354 B2
(45) Date of Patent: Oct. 18, 2022

(54) PATIENT SUPPORT WITH SELECTABLE PIVOT

(71) Applicant: Allen Medical Systems, Inc., Batesville, IN (US)

(72) Inventors: Zachary B. Konsin, Brighton, MA (US); Stephen B. Bishop, Marlborough, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 122 days.

(21) Appl. No.: 16/533,158

(22) Filed: Aug. 6, 2019

(65) Prior Publication Data

US 2020/0069498 A1 Mar. 5, 2020

Related U.S. Application Data

(60) Provisional application No. 62/724,728, filed on Aug. 30, 2018.

(51) Int. Cl.
*A61G 13/04* (2006.01)

(52) U.S. Cl.
CPC ..... *A61G 13/04* (2013.01); *A61G 2200/32* (2013.01); *A61G 2203/16* (2013.01); *A61G 2203/20* (2013.01); *A61G 2203/44* (2013.01)

(58) Field of Classification Search
CPC ..... A61G 13/04; A61G 2200/32; A61G 2203/44; A61G 2203/20; A61G 2203/16; A61G 2203/30; A61G 13/0036; A61G 13/06
See application file for complete search history.

(56) References Cited

U.S. PATENT DOCUMENTS

| | | | |
|---|---|---|---|
| 866,309 | A | 9/1907 | Scanlan |
| 1,021,335 | A | 3/1912 | Robinson et al. |
| 1,098,477 | A | 6/1914 | Cashman |
| 1,160,451 | A | 11/1915 | Sanford |
| 1,171,713 | A | 2/1916 | Gilkerson |
| 1,372,565 | A | 3/1921 | Skelly |
| 1,528,835 | A | 3/1925 | McCollough |
| 1,662,464 | A | 3/1928 | McCutchen |
| 1,799,692 | A | 4/1931 | Knott |
| 1,938,006 | A | 12/1933 | Blanchard |
| 2,103,693 | A | 12/1937 | Pohl |
| 2,188,592 | A | 1/1940 | Hosken |
| 2,261,297 | A | 11/1941 | Seib |
| 2,337,505 | A | 12/1943 | Swift |

(Continued)

FOREIGN PATENT DOCUMENTS

| | | |
|---|---|---|
| DE | 1162508 | 2/1964 |
| DE | 3438956 | 5/1985 |

(Continued)

OTHER PUBLICATIONS

Extended European Search Report for European Patent Application No. 19192339.0 dated Feb. 5, 2020 (7 pages).

*Primary Examiner* — Peter M. Cuomo
*Assistant Examiner* — Rahib T Zaman
(74) *Attorney, Agent, or Firm* — Barnes & Thornburg LLP

(57) ABSTRACT

Devices, systems, and methods for patient support including adjustable longitudinal angle of attached patient support tops. The reference point for longitudinal angle adjustment is itself adjustable to accommodate particular patient positioning.

22 Claims, 5 Drawing Sheets

(56) References Cited

U.S. PATENT DOCUMENTS 2,452,816 A 11/1948 Wagner
2,613,371 A 10/1952 Keyes, Jr.
2,636,793 A 4/1953 Meyer
2,667,169 A 1/1954 Kambourakis
2,688,410 A 9/1954 Nelson
2,691,979 A 10/1954 Watson
2,764,150 A 9/1956 Ettinger et al.
2,792,945 A 5/1957 Brenny
2,803,022 A 8/1957 Wynkoop
2,880,720 A 4/1959 Houghtaling
3,046,071 A 7/1962 Shampaine et al.
3,049,726 A 8/1962 Getz
3,090,381 A 5/1963 Watson
3,206,188 A 9/1965 Douglass, Jr.
3,226,734 A 1/1966 Coventon
3,238,539 A 3/1966 Albert
3,281,141 A 10/1966 Smiley
3,286,707 A 11/1966 Shafer
3,302,218 A 2/1967 Stryker
3,388,700 A 6/1968 Mountz
3,428,307 A 2/1969 Owen
3,434,165 A 3/1969 Keane
3,584,321 A 6/1971 Buchanan
3,599,964 A 8/1971 Magni
3,640,416 A 2/1972 Temple
3,652,851 A 3/1972 Zaalberg
3,739,406 A 6/1973 Koetter
3,745,996 A 7/1973 Rush
3,751,028 A 8/1973 Scheininger et al.
3,766,384 A 10/1973 Anderson et al.
3,795,018 A 3/1974 Broaded
3,814,414 A 6/1974 Chapa
3,827,089 A 8/1974 Grow
3,832,742 A 9/1974 Stryker
3,859,982 A 1/1975 Dove
3,873,081 A 3/1975 Smith et al.
3,895,403 A 7/1975 Davis et al.
3,946,452 A 3/1976 Eary
3,949,983 A 4/1976 Tommasino et al.
3,988,790 A 11/1976 Mracek et al.
4,071,916 A 2/1978 Nelson
4,101,120 A 7/1978 Seshima
4,131,802 A 12/1978 Braden et al.
4,144,880 A 3/1979 Daniels
4,148,472 A 4/1979 Rais
4,175,550 A 11/1979 Leininger et al.
4,186,917 A 2/1980 Rais et al.
4,227,269 A 10/1980 Johnston
4,239,039 A 12/1980 Thompson
4,244,358 A 1/1981 Pyers
4,257,407 A 3/1981 Macchi
4,356,577 A 11/1982 Taylor et al.
4,384,378 A 5/1983 Getz et al.
4,398,707 A 8/1983 Cloward
4,459,712 A 7/1984 Pathan
4,503,844 A 3/1985 Siczek et al.
4,545,571 A 10/1985 Chambron
4,552,346 A 11/1985 Schnelle et al.
4,579,111 A 4/1986 Ledesma
4,658,450 A 4/1987 Thompson
4,678,171 A 7/1987 Sanders
4,712,781 A 12/1987 Watanabe
4,730,606 A 3/1988 Leininger
4,763,643 A 8/1988 Vrzalik
4,769,584 A 9/1988 Irigoyen et al.
4,771,785 A 9/1988 Duer et al.
4,827,541 A 5/1989 Vollman
4,840,362 A 6/1989 Bremer et al.
4,850,775 A 7/1989 Lee et al.
4,858,128 A 8/1989 Alsip et al.
4,866,796 A 9/1989 Robinson et al.
4,868,937 A 9/1989 Connolly
4,872,657 A 10/1989 Lussi
4,887,325 A 12/1989 Tesch
4,924,537 A 5/1990 Alsip et al.
4,937,901 A 7/1990 Brennan
4,939,801 A 7/1990 Schaal et al.
4,944,054 A 7/1990 Bossert
4,944,500 A 7/1990 Mueller et al.
4,947,496 A 8/1990 Connolly
4,953,245 A 9/1990 Jung
4,970,737 A 11/1990 Sagel
5,020,170 A 6/1991 Ruf
5,088,706 A 2/1992 Jackson
5,131,106 A 7/1992 Jackson
5,152,024 A 10/1992 Chrones
5,161,267 A 11/1992 Smith
5,181,289 A 1/1993 Kassai
5,210,887 A 5/1993 Kershaw
5,210,888 A 5/1993 Canfield
5,231,741 A 8/1993 Maguire
5,239,716 A 8/1993 Fisk
5,274,862 A 1/1994 Palmer et al.
5,333,334 A 8/1994 Kassai
5,393,018 A 2/1995 Roth et al.
5,404,603 A 4/1995 Fukai et al.
5,444,882 A 8/1995 Andrews et al.
5,461,740 A 10/1995 Pearson
5,483,323 A 1/1996 Matsuda et al.
5,487,195 A 1/1996 Ray
5,499,408 A 3/1996 Nix
5,502,853 A 4/1996 Singleton et al.
5,524,304 A 6/1996 Shutes
5,544,371 A 8/1996 Fuller
5,579,550 A 12/1996 Bathrick et al.
5,588,705 A 12/1996 Chang
5,613,254 A 3/1997 Clayman et al.
5,658,315 A 8/1997 Lamb et al.
5,673,443 A 10/1997 Marmor
5,737,781 A 4/1998 Votel et al.
5,775,334 A 7/1998 Lamb et al.
5,778,467 A 7/1998 Scott et al.
5,794,286 A 8/1998 Scott et al.
5,890,238 A 4/1999 Votel et al.
5,901,388 A 5/1999 Cowan
5,926,871 A 7/1999 Howard
5,937,456 A 8/1999 Norris
5,950,259 A 9/1999 Boggs
6,003,174 A 12/1999 Kantrowitz et al.
6,035,465 A 3/2000 Rogozinski
6,042,558 A 3/2000 Hoyne et al.
6,049,923 A 4/2000 Ochiai
6,076,525 A 6/2000 Hoffman
6,094,760 A 8/2000 Nonaka et al.
6,108,838 A 8/2000 Connolly et al.
6,112,349 A 9/2000 Connolly
6,154,901 A 12/2000 Carr
6,230,342 B1 5/2001 Haugs
6,260,220 B1 7/2001 Lamb et al.
6,282,736 B1 9/2001 Hand
6,286,164 B1 9/2001 Lamb et al.
6,295,671 B1 10/2001 Reesby et al.
6,311,349 B1 11/2001 Kazakia et al.
6,315,564 B1 11/2001 Levisman
6,324,710 B1 12/2001 Hernandez et al.
6,385,801 B1 5/2002 Watanabe et al.
6,421,854 B1 7/2002 Heimbrock
6,438,777 B1 8/2002 Bender
6,460,206 B1 * 10/2002 Blasche ..... A61B 6/0487 5/601
6,496,991 B1 12/2002 Votel
6,499,158 B1 12/2002 Easterling
6,499,160 B2 12/2002 Hand et al.
6,505,365 B1 1/2003 Hanson et al.
6,523,197 B2 2/2003 Zitzmann
6,526,610 B1 3/2003 Hand
6,584,630 B1 7/2003 Dinkler
6,609,260 B2 8/2003 Hand et al.
6,615,430 B2 9/2003 Heimbrock
6,622,324 B2 9/2003 VanSteenburg et al.
6,634,043 B2 10/2003 Lamb et al.
6,637,058 B1 10/2003 Lamb
6,638,299 B2 10/2003 Cox
6,662,388 B2 12/2003 Friel et al.

(56) References Cited

U.S. PATENT DOCUMENTS 6,662,391 B2 12/2003 Wilson et al.
6,668,396 B2 12/2003 Wei
6,671,904 B2 1/2004 Easterling
6,681,423 B2 1/2004 Zachrisson
6,691,347 B2 2/2004 Hand et al.
6,701,553 B1 3/2004 Hand
6,701,554 B2 3/2004 Heimbrock
6,721,976 B2 4/2004 Schwaegerle
6,813,788 B2 11/2004 Dinkler et al.
6,817,363 B2 11/2004 Biondo et al.
6,854,137 B2 2/2005 Johnson
6,857,144 B1 2/2005 Huang
6,859,967 B2 3/2005 Harrison et al.
6,862,759 B2 3/2005 Hand et al.
6,862,761 B2 3/2005 Hand et al.
6,874,181 B1 4/2005 Vijayendran
6,886,199 B1 5/2005 Schwaegerle
6,898,811 B2 5/2005 Zucker et al.
6,912,959 B2 7/2005 Kolody et al.
6,928,676 B1 8/2005 Schwaegerle
6,941,951 B2 9/2005 Hubert et al.
6,966,081 B1 11/2005 Sharps et al.
6,971,997 B1 12/2005 Ryan et al.
6,986,179 B2 1/2006 Varadharajulu et al.
7,020,917 B1 4/2006 Kolody et al.
7,080,422 B2 7/2006 Ben-Levi
7,086,103 B2 8/2006 Barthelt
7,089,612 B2 8/2006 Rocher et al.
7,089,884 B2 8/2006 Wang et al.
7,103,932 B1 9/2006 Kandora
7,137,160 B2 11/2006 Hand et al.
7,152,261 B2 12/2006 Jackson
7,171,709 B2 2/2007 Weismiller
7,197,778 B2 4/2007 Sharps
7,214,138 B1 5/2007 Stivers et al.
7,216,385 B2 5/2007 Hill
7,234,180 B2 6/2007 Horton et al.
7,290,302 B2 11/2007 Sharps
7,343,635 B2 3/2008 Jackson
7,343,916 B2 3/2008 Biondo et al.
7,496,980 B2 3/2009 Sharps
7,520,007 B2 4/2009 Skripps
7,520,008 B2 4/2009 Wong et al.
7,565,708 B2 7/2009 Jackson
7,600,281 B2 10/2009 Skripps
7,653,953 B2 2/2010 Lopez-Sansalvador et al.
7,669,262 B2 3/2010 Skripps
7,681,269 B2 3/2010 Biggie et al.
7,694,369 B2 4/2010 Hinders et al.
7,739,762 B2 6/2010 Lamb
7,810,185 B2 10/2010 Burstner et al.
7,824,353 B2 11/2010 Matta
7,861,720 B1 1/2011 Wolcott
7,882,583 B2 2/2011 Skripps
7,931,607 B2 4/2011 Biondo et al.
7,954,996 B2 6/2011 Boomgaarden et al.
D645,967 S 9/2011 Sharps
8,020,227 B2 9/2011 Dimmer et al.
8,042,208 B2 10/2011 Gilbert et al.
8,056,163 B2 11/2011 Lemire
8,060,960 B2 11/2011 Jackson
8,118,029 B2 2/2012 Gneiting et al.
D663,427 S 7/2012 Sharps
D665,912 S 8/2012 Skripps
8,234,730 B2 8/2012 Skripps
8,234,731 B2 8/2012 Skripps
8,256,050 B2 9/2012 Wong et al.
8,286,283 B2 10/2012 Copeland et al.
D676,971 S 2/2013 Sharps
8,381,331 B2 2/2013 Sharps et al.
8,397,323 B2 3/2013 Skripps et al.
D683,032 S 5/2013 Sharps
8,464,375 B1 6/2013 Jorgensen et al.
8,486,068 B2 7/2013 Starr
8,555,439 B2 10/2013 Soto et al.
8,584,281 B2 11/2013 Diel et al.
8,590,074 B2 11/2013 Hornbach et al.
8,635,725 B2 1/2014 Tannoury et al.
8,676,293 B2 3/2014 Breen et al.
8,677,529 B2 3/2014 Jackson
8,707,476 B2 4/2014 Sharps
8,707,484 B2 4/2014 Jackson et al.
8,719,979 B2 5/2014 Jackson
8,732,876 B2 5/2014 Lachenbruch et al.
8,763,178 B1 7/2014 Martin et al.
8,777,878 B2 7/2014 Deitz
8,782,832 B2 7/2014 Blyakher et al.
8,806,679 B2 8/2014 Soto et al.
8,826,474 B2 9/2014 Jackson
8,826,475 B2 9/2014 Jackson
8,833,707 B2 9/2014 Steinberg et al.
8,839,471 B2 9/2014 Jackson
8,844,077 B2 9/2014 Jackson et al.
8,845,264 B2 9/2014 Kubiak et al.
8,856,986 B2 10/2014 Jackson
8,864,205 B2 10/2014 Lemire et al.
8,893,333 B2 11/2014 Soto et al.
D720,076 S 12/2014 Sharps et al.
8,938,826 B2 1/2015 Jackson
8,978,180 B2 3/2015 Jackson
8,997,286 B2 4/2015 Wyslucha et al.
9,078,628 B2 * 7/2015 Cumpson ..... A61B 5/704
9,119,610 B2 9/2015 Matta et al.
9,180,062 B2 11/2015 Jackson
9,205,013 B2 12/2015 Jackson
9,211,223 B2 12/2015 Jackson
9,233,037 B2 1/2016 Sharps et al.
9,289,342 B2 3/2016 Jackson
9,295,433 B2 3/2016 Jackson et al.
9,308,145 B2 4/2016 Jackson
9,339,430 B2 5/2016 Jackson et al.
9,364,380 B2 6/2016 Jackson
9,498,397 B2 11/2016 Hight et al.
9,642,760 B2 * 5/2017 Jackson ..... G16H 40/63
10,363,189 B2 7/2019 Hight et al.
2004/0133983 A1 7/2004 Newkirk et al.
2005/0155149 A1 7/2005 Pedersen
2005/0235415 A1 10/2005 Pedersen et al.
2006/0123552 A1 6/2006 Ben-Levi
2007/0157385 A1 * 7/2007 Lemire ..... A61G 7/0509 5/600
2008/0000028 A1 1/2008 Lemire et al.
2009/0044813 A1 2/2009 Gneiting et al.
2009/0205139 A1 8/2009 Van Deursen et al.
2009/0282614 A1 11/2009 Jackson
2010/0192300 A1 8/2010 Tannoury et al.
2011/0099716 A1 * 5/2011 Jackson ..... A61G 13/08 5/607
2011/0107516 A1 5/2011 Jackson
2012/0144589 A1 6/2012 Skripps
2012/0198625 A1 8/2012 Jackson
2013/0111666 A1 5/2013 Jackson
2013/0205500 A1 8/2013 Jackson
2013/0219623 A1 * 8/2013 Jackson ..... A61G 13/0036 5/613
2013/0254995 A1 10/2013 Jackson
2013/0254996 A1 10/2013 Jackson
2013/0254997 A1 10/2013 Jackson
2013/0269710 A1 10/2013 Hight et al.
2013/0312181 A1 11/2013 Jackson et al.
2013/0312187 A1 11/2013 Jackson
2013/0312188 A1 11/2013 Jackson
2013/0326813 A1 12/2013 Jackson
2014/0007349 A1 1/2014 Jackson
2014/0020181 A1 1/2014 Jackson
2014/0033436 A1 2/2014 Jackson
2014/0068861 A1 3/2014 Jackson et al.
2014/0082842 A1 3/2014 Jackson
2014/0109316 A1 4/2014 Jackson et al.
2014/0173826 A1 6/2014 Jackson
2014/0196212 A1 7/2014 Jackson
2014/0201913 A1 7/2014 Jackson
2014/0201914 A1 7/2014 Jackson
2014/0208512 A1 7/2014 Jackson

(56) References Cited

U.S. PATENT DOCUMENTS

| | | | | |
|---|---|---|---|---|
| 2014/0317847 | A1 | 10/2014 | Jackson | |
| 2014/0325759 | A1 | 11/2014 | Bly | |
| 2015/0059094 | A1 | 3/2015 | Jackson | |
| 2015/0150743 | A1 | 6/2015 | Jackson | |
| 2015/0182400 | A1* | 7/2015 | Meyer ..... | A61G 7/05715 5/710 |
| 2015/0283017 | A1 | 10/2015 | Harris, Jr. | |
| 2016/0000621 | A1 | 1/2016 | Jackson et al. | |
| 2016/0000626 | A1 | 1/2016 | Jackson et al. | |
| 2016/0000627 | A1 | 1/2016 | Jackson et al. | |
| 2016/0000629 | A1 | 1/2016 | Jackson et al. | |
| 2016/0361218 | A1 | 12/2016 | Dubois et al. | |
| 2017/0112699 | A1 | 4/2017 | Hight et al. | |
| 2019/0262204 | A1 | 8/2019 | Hertz et al. | |

FOREIGN PATENT DOCUMENTS

| | | | |
|---|---|---|---|
| DE | 4039907 | | 7/1991 |
| DE | 4429062 | | 8/2000 |
| DE | 19723927 | | 5/2003 |
| DE | 10158470 | | 6/2003 |
| DE | 202008001952 | | 6/2008 |
| EP | 617947 | | 1/1995 |
| EP | 0501712 | | 7/1996 |
| EP | 1210049 | | 6/2002 |
| EP | 1686944 | | 8/2006 |
| EP | 1159947 | | 9/2006 |
| EP | 1982680 | | 7/2011 |
| EP | 3354248 | A1 | 8/2018 |
| FR | 2247194 | | 5/1975 |
| GB | 2210554 | | 9/1989 |
| JP | 2001112582 | | 4/2001 |
| WO | 2004026212 | | 4/2004 |
| WO | 2006006106 | | 1/2006 |
| WO | 2006061606 | | 6/2006 |
| WO | 2009054969 | | 4/2009 |
| WO | 2009071787 | | 6/2009 |
| WO | 2011162803 | | 12/2011 |

* cited by examiner

PATIENT SUPPORT WITH SELECTABLE PIVOT

The present application claims the benefit, under 35 U.S.C. § 119(e), of U.S. Provisional Application No. 62/724,728, filed Aug. 30, 2018, which is hereby incorporated by reference herein in its entirety.

BACKGROUND

The present disclosure relates to devices, systems, and methods for patient support. More specifically, the present disclosure relates to devices, systems, and methods for surgical patient support.

Patient supports, such as surgical support tables, provide support to various portions of a patient's body. Versatile positioning of table tops of the patient supports provides access to various parts of a patient's body to assist in patient treatment and/or diagnosis. Positioning patient supports should be performed with consideration for the safety and security of the patient while promoting ease of operation to the user.

SUMMARY

The present application discloses one or more of the features recited in the appended claims and/or the following features which, alone or in any combination, may comprise patentable subject matter:

According to an aspect of the present disclosure, a patient support for supporting a patient may include at least one patient top for supporting a patient's body above the floor, the at least one patient top extending longitudinally for a length, and at least one end support coupled with the patient top to support the patient top for selective adjustment of a longitudinal angle of the at least one patient top relative to a defined pivot point. The defined pivot point may be selectively assignable along the length of the at least one patient top.

In some embodiments, the defined pivot point may be selectively assignable to correspond with a first assignment at the longitudinal center of the at least one patient top and to correspond with a second assignment off-center from the longitudinal center of the at least one patient top. In some embodiments, the defined pivot point may correspond with a center of rotation of the patient support for adjustment of the longitudinal angle of the at least one patient top. The defined pivot point may be offset from the at least one patient top by a predetermined distance for accommodating a surgical site of a patient's body as the center of rotation of the patient support.

In some embodiments, the patient support may include a pivot interface for receiving user assignment of the defined pivot point along the length of the patient top. The pivot interface may include at least one sensor arranged to receive user activation to assign the defined pivot point along the length of the patient top. The at least one sensor may include a potentiometer extending along the length of the patient top for receiving user contact at an desired position to assign the defined pivot point along the length of the patient top.

In some embodiments, the at least one patient top may include a frame having at least one side rail extending longitudinally, and a raceway secured with the frame for mounting of the pivot interface. The raceway may define a channel for housing at least one sensor for user activation to assign the defined pivot point along the length of the patient top. The raceway may include a base secured with a side of the frame and the channel is open to receive user activation.

In some embodiments, the patient support may include an alert system for indicating the present assignment of the defined pivot point along the length of the patient top. The alert system may include a visual indicator displaying a marking at the defined pivot point along the length of the patient top. The visual indicator may include an LED strip arranged to illuminate a portion of the LED strip as the marking at the defined pivot point along the length of the patient top.

In some embodiments, the patient support may include a graphical user interface configured to receive user activation to assign the defined pivot point. In some embodiments, the patient support may include an alert system for indicating the present assignment of the defined pivot point. The alert system may include a graphical depiction presented on the graphical user interface of the patient top having a graphical indication of the present assignment of the defined pivot point. The graphical depiction of the present assignment of the defined pivot point may be presented on the graphical user interface according to user activation of at least one of the graphical user interface and a pivot interface for receiving user assignment of the defined pivot point along the length of the patient top. The pivot interface may include at least one sensor having a potentiometer extending along the length of the patient top for receiving user contact at an desired position to assign the defined pivot point.

In some embodiments, the alert system may include a visual indicator that displays a marking at the present assignment of the defined pivot point along the length of the patient top. The visual indicator may include an LED strip arranged along the length of the patient top to illuminate a portion of the LED strip as the marking at the defined pivot point along the length of the patient top.

According to another aspect of the present disclosure, a patient support top for connection with at least one end support of a patient support to support a patient for selective longitudinal angle adjustment relative to a defined pivot point may include a frame extending longitudinally for a length and arranged for connection with the at least one end support, an alert system for signaling the present assignment of the defined pivot point along the length of the frame, and communication circuitry for communication of the desired assignment of the defined pivot point with a control system of the patient support. The communication circuitry may be in communication with the alert system to communicate an indication of the desired assignment of the defined pivot point.

In some embodiments, the defined pivot point may be selectively assignable to correspond with a first assignment at the longitudinal center of the frame and to correspond with a second assignment off-center from the longitudinal center of the frame. The defined pivot point may correspond with a center of rotation of the frame for adjustment of the longitudinal angle of the patient support top. The defined pivot point may be offset from the patient support top by a predetermined distance for accommodating a surgical site of a patient's body as the center of rotation of the frame.

In some embodiments, the communication circuitry may include a pivot interface for receiving user assignment of the defined pivot point along the length of the frame. The pivot interface may include at least one sensor arranged to receive user activation to assign the defined pivot point along the length of the patient top. The at least one sensor may include a potentiometer extending along the length of the patient top for receiving user contact at an desired position to assign the defined pivot point along the length of the patient top.

In some embodiments, the frame may include at least one side rail extending longitudinally, and a raceway secured with the frame for mounting of the pivot interface. The raceway may define a channel for housing at least one sensor for user activation to assign the defined pivot point along the length of the frame. The raceway may include a base secured with a side of the frame and the channel is open to receive user activation.

In some embodiments, the alert system may include a visual indicator displaying a marking at the defined pivot point along the length of the patient top. The visual indicator may include an LED strip arranged to illuminate a portion of the LED strip as the marking at the defined pivot point along the length of the patient top.

In some embodiments, the patient support top may include a graphical user interface configured to receive user activation to assign the defined pivot point. The graphical user interface may be configured to present a graphical depiction of the patient top having a graphical indication of the present assignment of the defined pivot point. The graphical depiction of the present assignment of the defined pivot point may be presented on the graphical user interface according to user activation of at least one of the graphical user interface and a pivot interface for receiving user assignment of the defined pivot point along the length of the patient top.

In some embodiments, the pivot interface may include at least one sensor having a potentiometer extending along the length of the patient top for receiving user contact at an desired position to assign the defined pivot point. In some embodiments, the alert system may include a visual indicator that displays a marking at the present assignment of the defined pivot point along the length of the frame. The visual indicator may include an LED strip arranged along the length of the patient top to illuminate a portion of the LED strip as the marking at the defined pivot point along the length of the patient top.

According to another aspect of the present disclosure, a patient support assembly for support of a patient with selective adjustment of a longitudinal angle of the patient relative to a defined pivot point may include at least one patient top for supporting the patient above the floor, the at least one patient top extending longitudinally for a length, at least one support tower for supporting the at least one patient top above the floor for selective adjustment of a longitudinal angle of the patient, and a user interface adapted to adjust the longitudinal angle of the at least one patient top relative to the defined pivot point according to user input, wherein the defined pivot point is selectively assignable along the length of the at least one patient top.

In some embodiments, the patient support top may include an alert system for signaling the present assignment of the defined pivot point along the length of the patient top. The alert system may include a visual indicator that displays a marking at the present assignment of the defined pivot point along the length of the patient top.

In some embodiments, the user interface may be a graphical user interface for access to operation of the patient support assembly. In some embodiments, the patient support top may include another user interface extending along the length of the at least one patient support top. The graphical user interface may be configured to receive user activation to assign the defined pivot point. The graphical user interface may be configured to present a graphical depiction of the at least one patient top having a graphical indication of the present assignment of the defined pivot point. The graphical indication of the present assignment of the defined pivot point may be presented on the graphical user interface according to user activation of at least one of the graphical user interface and a pivot interface for receiving user assignment of the defined pivot point along the length of the at least one patient top.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION

Figure 1:
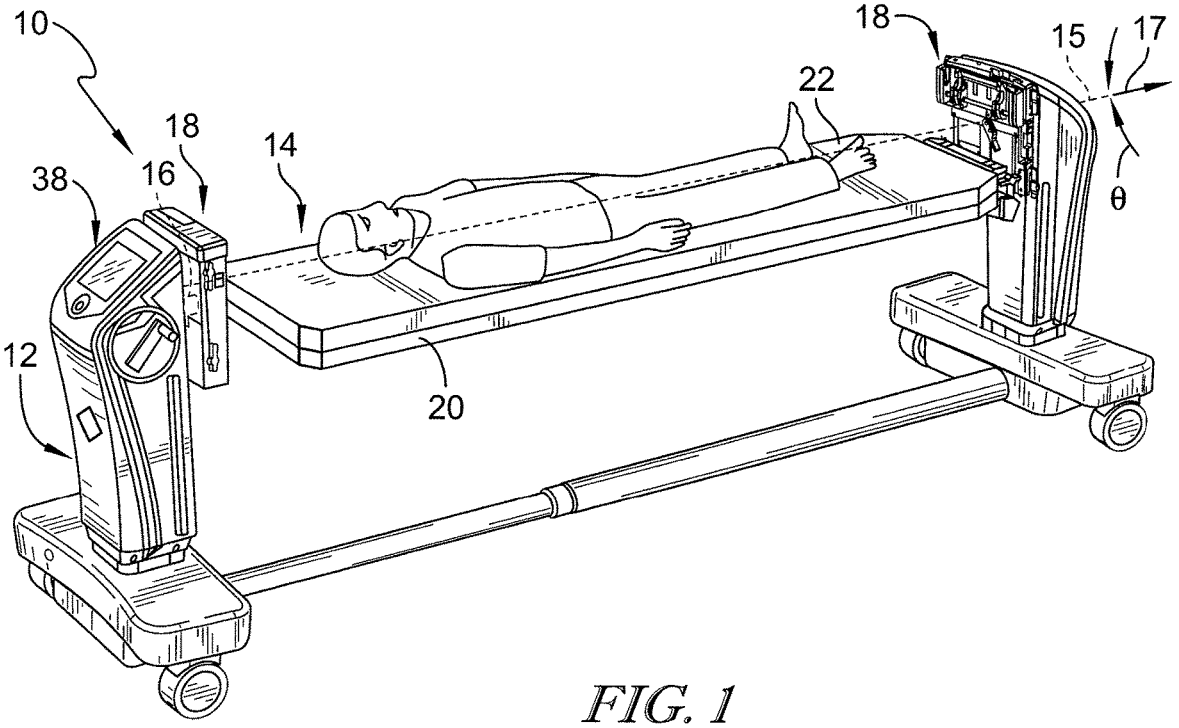
FIG. 1 is a perspective view of a patient support for supporting a patient's body above the floor showing that the patient support includes a pair of elevator towers connected with a support top for receiving the patient.

For the purposes of promoting an understanding of the principles of the disclosure, reference will now be made to a number of illustrative embodiments illustrated in the drawings and specific language will be used to describe the same.

In performance of various procedures, whether surgical, treatment, diagnosis, or otherwise, providing desirable access to a patient's body areas can be beneficial. For example, in performing surgical procedures, providing surgical access to surgical sites on a patient's body can promote favorable surgical conditions and can increase the opportunity for successful results. Patient support devices can assist in suitably positioning the patient's body in various manners to provide a surgical team with preferred and/or appropriate access to particular surgical sites.

Patient support devices can include patient support tops which are supported above the floor by support structures. Such support structures can provide enhanced maneuverability to assist in positioning the patient's body by permitting selective movement of the patient support top. The safety concerns related to positioning a patient's body can impose complex and/or multi-step processes onto the positioning devices. Ease of operating the positioning devices can reduce user strain, reduce time in positioning, and reduce impact to the patient in obtaining various patient body positions.

In the illustrative embodiment as shown in FIG. 1, a patient support 10 includes a pair of tower bases 12 and a patient support top 14 connected at each longitudinal end with one of the tower bases 12. The tower bases 12 illustratively support the patient support top 14 above the floor and are embodied as elevator towers permitting selective vertical extension to adjust the height of the patient support top 14 above the floor. As discussed in additional detail herein, the tower bases 12 support the patient support top 14 for selective positioning to arrange the patient's body.

In the illustrative embodiment as shown in FIG. 1, the patient support top 14 extends longitudinally between the tower bases 12. An axis 15 is defined between the tower bases 12 as a reference of coordinated arrangement of the patient support top 14, discussed in additional detail below. In the illustrative embodiment, the axis 15 is presently defined level with the floor and having angle theta (θ) equal to about zero relative to the axis 17 which is fixed to be parallel to the floor. The patient support 10 is arranged for selective adjustment of the longitudinal angle of the patient support top 14.

The tower bases 12 each illustratively include a connection rod 16 connected with the support top 14 by a connection assembly 18. Non-limiting examples of acceptable connection bars and connection (coupler) assemblies are disclosed in U.S. Patent Application Publication No. 2013/0269710 to Hight et al., (for example, shaft 112 may form the connection rod 16), the contents of which are hereby incorporated by reference in their entirety, and at least including the descriptions and figures related to yoke brackets and motion couplers and related features disclosed therein. In some embodiments, the patient support top 14 may be connected with the connection rod 16 in any suitable manner. In the illustrative embodiment, the connection rods 16 are illustratively arranged for controlled rotation about the axis 15 to provide rotation to the support top 14. Although generally shown as horizontal, the axis 15 may be selectively inclined by operation of the elevator towers and/or the connection assemblies 18 to adjust the height of their respective connection with the patient support top 14.

The patient support top 14 is illustratively embodied as a flat platform including a rail frame 20 having a deck that is covered with support padding 22. The support top 14 is embodied as adapted for support of a patient in the supine position, including padding 22 arranged accordingly, but in some embodiments, may be adapted for support of a patient in any suitable position. The patient support top 14 is selectively connected with the connection rod 16 of each tower base 12 via the respective connection assembly 18 and is positionable for selective angling and rotation about axis 15.

Figure 2:
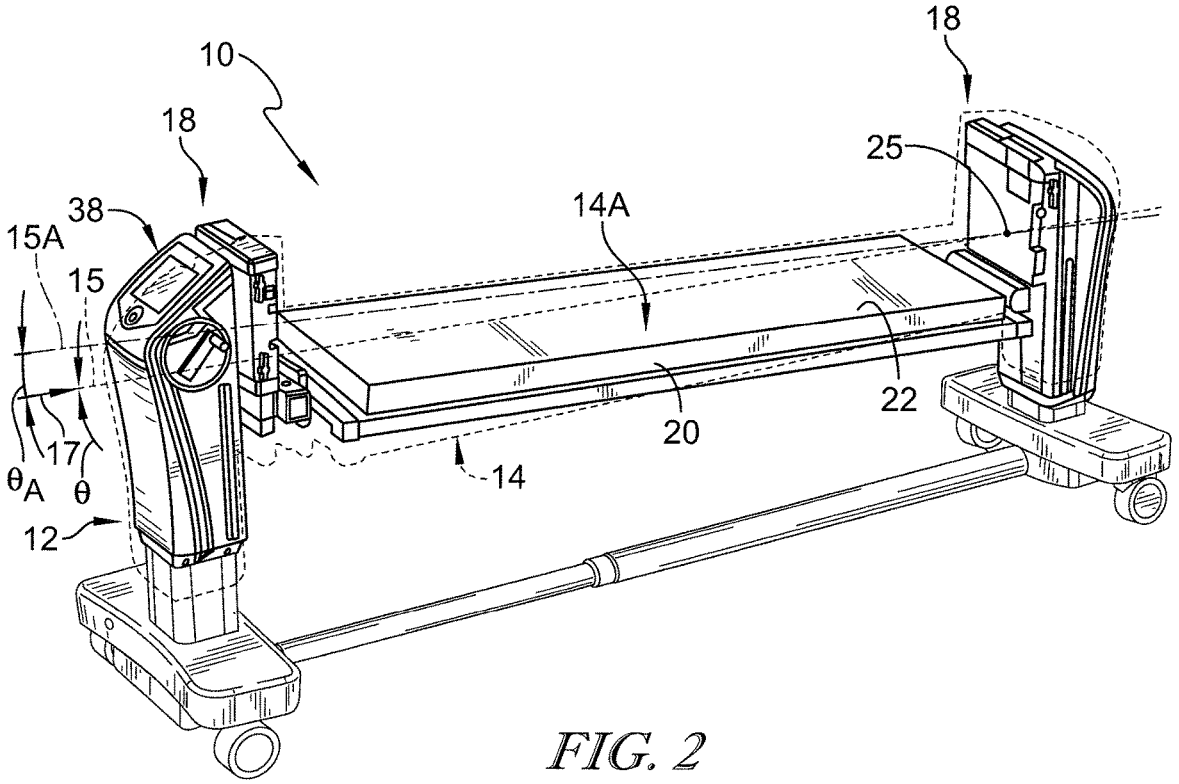
FIG. 2 is a perspective of the patient support of FIG. 1 showing that the support top can be adjusted between a first position (dashed line) and a second position (solid line) having articulated longitudinal angle (Trendelenburg angle) to provide suitable positioning of the patient's body.

In the illustrative embodiment as shown in FIG. 2, the patient support 10 is shown in a first position having a longitudinal angle theta (θ) equal to zero (relative to level represented by axis 17). The first position of the patient support 10 is shown representing support top 14 in broken line and angle theta (θ) defined between the level axis 17 and the axis 15, angle theta (θ) embodied to be zero degrees. A second position of the patient support 10 is shown representing the support top 14A in solid line having a longitudinal angle theta$_A$ ($\theta_A$) defined between adjusted axis 15$_A$ and level 17, embodied to be about 10 degrees. Adjusting the longitudinal angle between the first position θ and the second position $\theta_A$ can provide the user (e.g., caregiver) preferred access to the patient's body occupying the support top.

In the illustrative embodiment, the longitudinal angle can also be referred to as the Trendelenburg angle, which can include negative Trendelenburg angle. One suitable example of a patient support having adjustable Trendelenburg angle is disclosed within U.S. Provisional Patent Application No. 62/636,563, the contents of which are hereby incorporated by reference, in their entirety, and including at least those portions related to adjustable patient support. In some embodiments, the patient supports of the present disclosure may include additional adjustments features including but without limitation, adjustment of flip rotation, height, tilt, level, leg drop, any other feature disclosed within U.S. Provisional Patent Application No. 62/636,563, and/or any other suitable adjustment, for example but without limitation, the patient support 10 of the present disclosure may be arranged for flip rotation about its axis 15, as disclosed within U.S. Provisional Patent Application No. 62/636,563.

Figure 3:
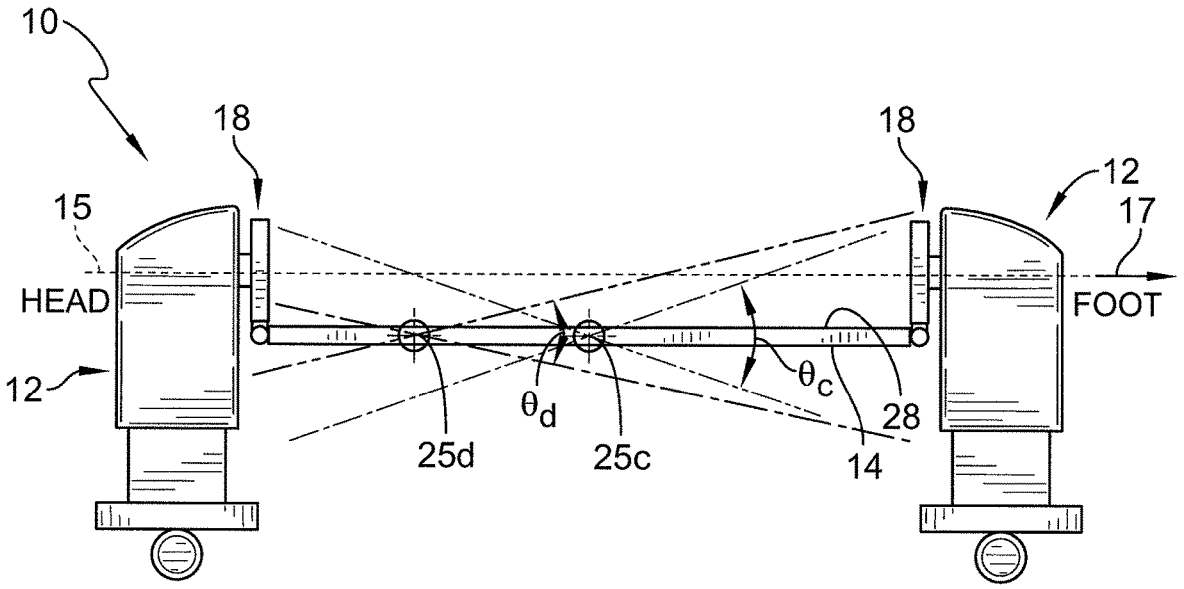
FIG. 3 is an elevation view of the patient support of FIGS. 1 and 2 showing that a pivot point of the support top for longitudinal angle adjustment is indicated on a side of the support top and a range of longitudinal angle adjustment is indicated.

Referring now to the illustrative embodiment as shown in FIG. 3, a pivot point 25 is shown about which the longitudinal angle is adjusted. The pivot point 25 is presently defined at a central position along the longitudinal length of the patient support top 14 designated as 25*c* for descriptive purposes. From that central pivot point 25*c*, the longitudinal angle of the support top 14 can be adjusted within the range of angles $\theta_c$ having the pivot point 25*c*. As explain in additional detail herein, the user can elect to alter the location of the pivot point 25 along the patient support 14 to provide preferred positioning of an occupying patient's body.

As shown in FIG. 3, an alternative pivot point 25*d* is shown as a user's selected location of adjustment of the pivot point 25. Here, the user has illustratively selected to adjust the location of the pivot point 25 to be indicated at 25*d* to the left of the central pivot point 25*c* in the orientation shown in FIG. 3 (towards the head end). At the defined pivot point 25*d*, adjustment of the longitudinal angle can proceed about the pivot point 25*d* through the range of angles $\theta_d$. Accordingly, the pivot point 25 as the hinge point for pivoting of the support top 14 can be selectively assigned by the user along the length of the support top 14.

Figure 4:
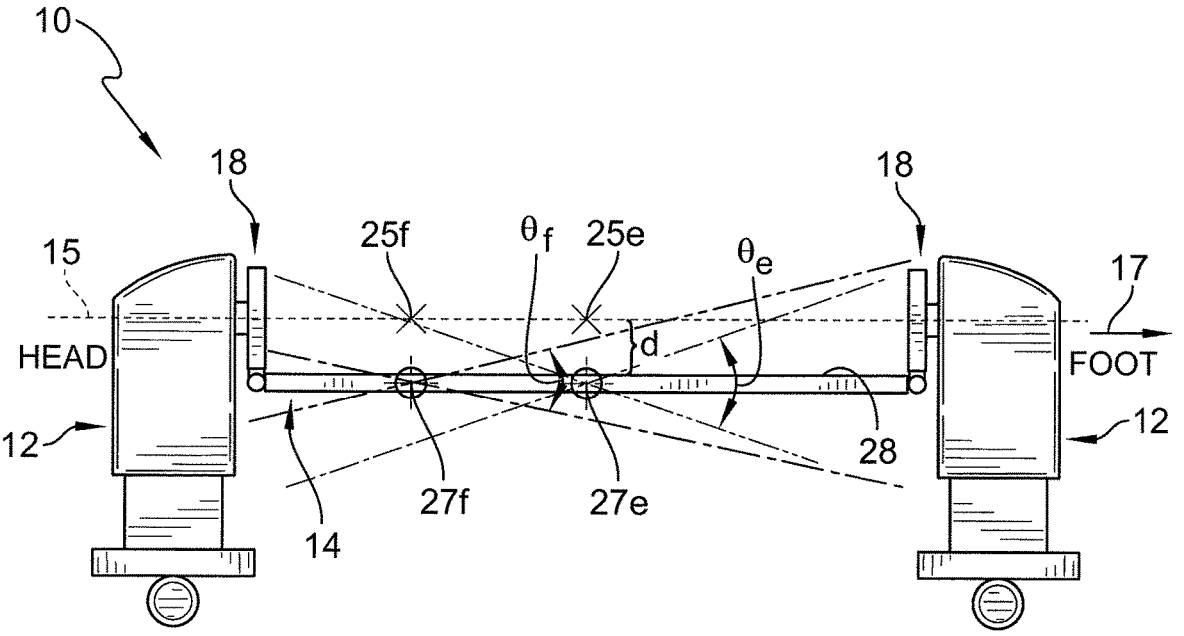
FIG. 4 is an elevation view of the patient support of FIGS. 1-3 showing that the pivot point of the support top for longitudinal angle adjustment is indicated spaced apart from the support top to target a location on the patient's body.

Referring now to FIG. 4, the pivot point 25*e* is assigned to be arranged on the axis 15, spaced apart from the support top 14. Namely, the pivot point 25*e* is spaced apart vertically from a top surface 28 of the support top 14 by a distance of d. The distance d is illustratively defined to arrange the pivot point 25*e* at the same height as the axis 15, but the distance d may be defined to have any suitable value, for example but without limitation, about −30 to about 30 inches relative to the top surface 28. The top surface 28 is embodied to be the contact surface of the support top 14 for engagement with the patient's body, and therefore can be formed by the suitable padding 22 (not shown in FIG. 3 for descriptive purposes).

The longitudinal angle of the support top 14 about the defined pivot point 25*e* is adjustable within the range of angles $\theta_e$. The lateral location of the pivot point 25*e* along the support top 14 is also indicated on the support top 14 by 27*e* as discussed in additional detail below. By arranging the pivot point 25 to be spaced apart from the support top 14, a particular location of the patient's body can be closely targeted as the pivot point assignment location, for example, a point on the occupying patient's body desired for surgical access which itself is spaced apart from the surface 28 of the support top 14. During adjustment of the longitudinal angle of the support top 14, the portion of the patient's body at the defined pivot point 25*e* can be maintained mostly stationary to assist appropriate access to the point of the patient's body. In some embodiments, the longitudinal position of the support top 14 can be shifted, for example, by articulation and/or translation of the connection assemblies 18 and/or rods 16, to arc about the pivot point 25*e*, more particularly, the rods 16 may be telescopic to allow horizontal shifting of the support top 14 to provide additional focusing on defined pivot point locations off-set from the support top 14.

As shown in FIG. 4, the user can select the alternative location as pivot point 25*f*. The longitudinal angle for the defined pivot point 25*f* is adjustable within the range of angles $\theta_f$. During adjustment of the longitudinal angle of the support top 14, the defined pivot point 25*f* can be maintained (nearly) stationary to assist appropriate access to the point of the patient's body. In some embodiments, as required, the longitudinal position of the support top 14 can be shifted to arc about the pivot point 25*f* to maintain the defined pivot point 25*f* (nearly) stationary.

The lateral location of the pivot point 25*f* along the support top 14 is indicated on the support top 14 by 27*f* Accordingly, the lateral and vertical location of the pivot point can be assigned as desired by the user to accommodate customized surgical access during longitudinal angle adjustment. In the illustrative embodiment, the distance d defining the spacing of the defined pivot point 25 above the surface 28 can be predetermined (and adjusted) by the user. The indications 27 on the support top 14 can indicate the point of interaction for the user to engage as an input to assign the location of the pivot point 25 and/or as an indication of the current location of the pivot point 25 as discussed in additional detail herein.

Figure 5A:
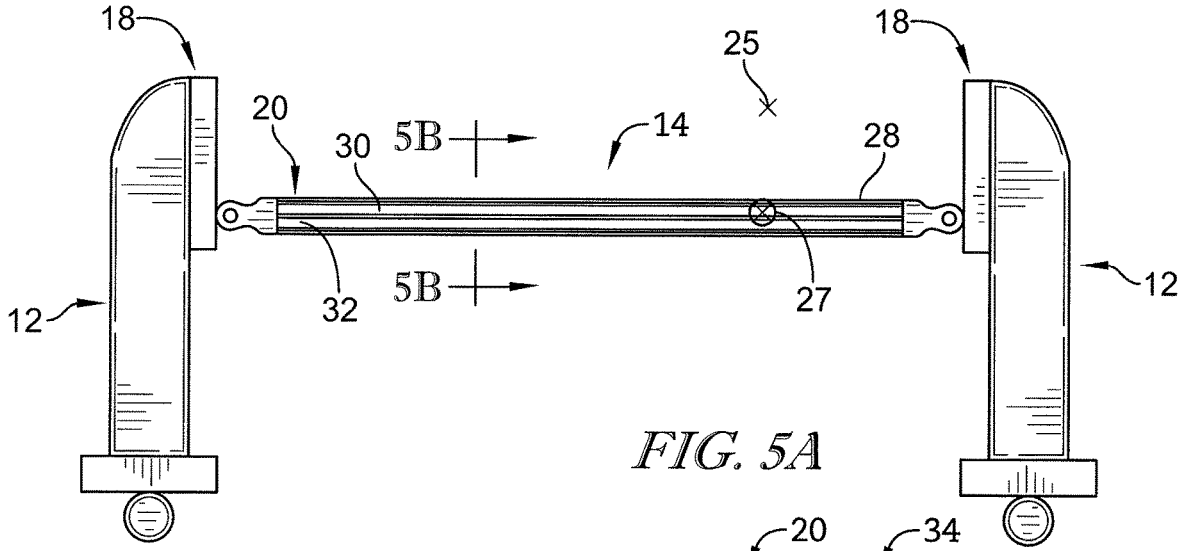
FIG. 5A is an elevation view of the patient support of FIGS. 1-4 showing that the support top includes an indicator for indicating the present position of the pivot point and an interface for receiving user selection of the position of the pivot point.
Figure 5B:
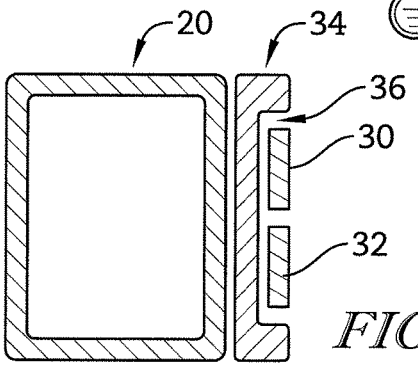
FIG. 5B is a cross-section of a portion of the patient support of FIG. 5A showing that the support top includes a rail having a track for housing the indicator and interface.

Referring now to FIGS. 5A and 5B, the rail 20 of the support top 14 illustratively includes an indicator 30 and an input 32. The indicator 30 is illustratively embodied as a light source, namely an light emitting diode (LED) strip spanning the longitudinal length of the rail 20. The indicator 30 is adapted to illuminate at the present location of the indication 27 to identify the defined lateral position of the pivot point 25. The input 32 is illustratively embodied as a soft potentiometer adapted for use as a user interface for receiving user engagement to define the pivot point location.

As shown in FIG. 5B, the rail 20 may include a track 34 secured to an exterior side thereof. The track 34 illustratively defines an open cavity 36 within which the indicator 30 and/or the input 32 can be arranged. The indicator 30 and input 32 face outward from the cavity 36 for interaction with the user such that the user can view the indicator 30 and engage the input 32.

Figure 6:
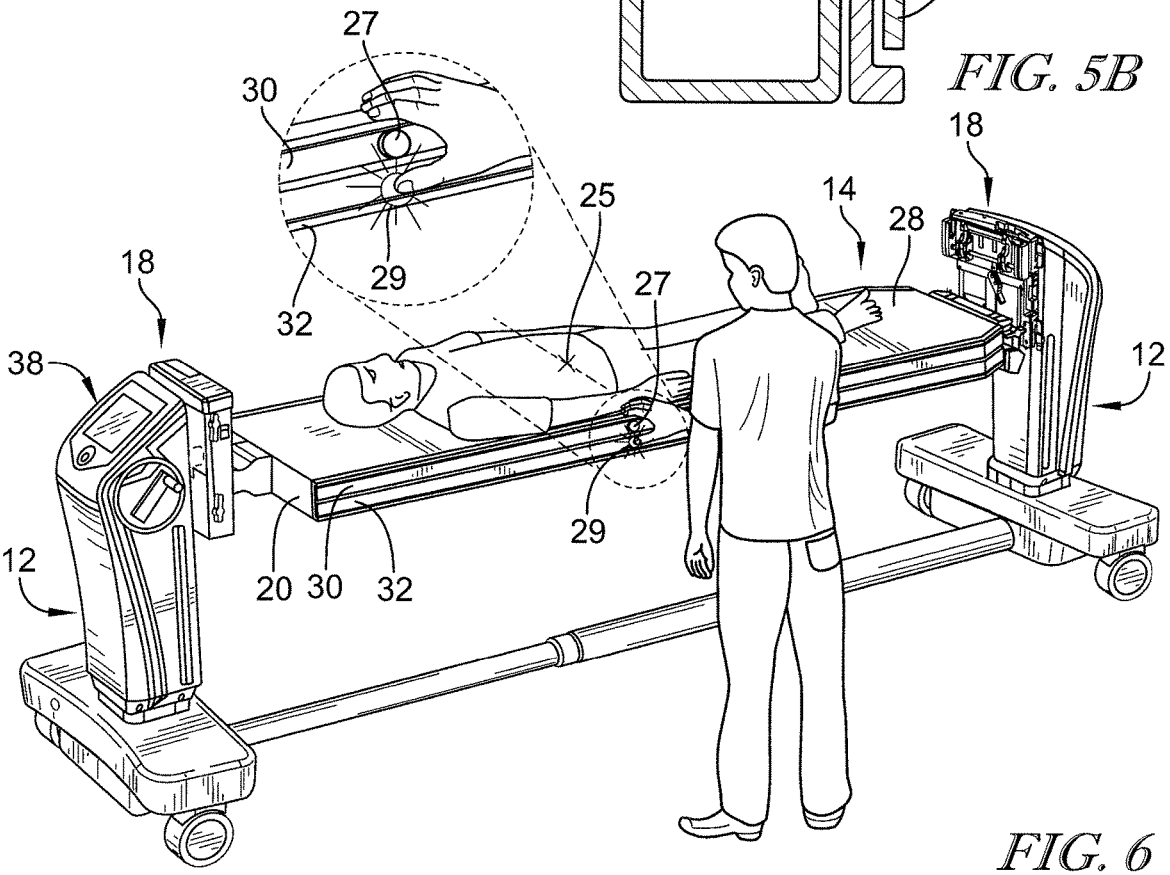
FIG. 6 is a perspective view of the patient support top of FIG. 1-5B showing that a user can select the pivot point location and showing that the patient support includes a graphic user interface.

Referring to FIG. 6, the input 32 is adapted for engagement by the user in the form of contact by the user's finger, for example, by depressing at the desired location. In some embodiments, the indicator 30 may include any suitable visual indication device and/or the input 32 may include any suitable user interface device. In some embodiments, the indicator 30 and input 32 may be combined into a single device performing each of indicating and input. The point of user engagement with the input 32 is indicated by numeral 29 which corresponds in position with the longitudinal position of the indication 27 and the defined pivot point 25. As seen in FIG. 6, the pivot point 25 in fact defines the axis of Trendelenburg pivoting and is thus not a singular point per se.

As shown in FIG. 6, the patient support 10 illustratively includes a graphic user interface (GUI) 38 for user interface to access operations of the patient support 10. The GUI 38 is embodied as a touch screen for display of text and graphics and receipt of user inputs for configuration of the patient support 10. The GUI 38 is illustratively shown as part of the head end base tower 12, but may be adapted in any suitable arrangement for user interface. The GUI 38 can include textual display of the Trendelenburg angle, distance d, and/or other suitable parameters, and may be configurable to have text and/or graphics as preferred by the user.

Figure 7:
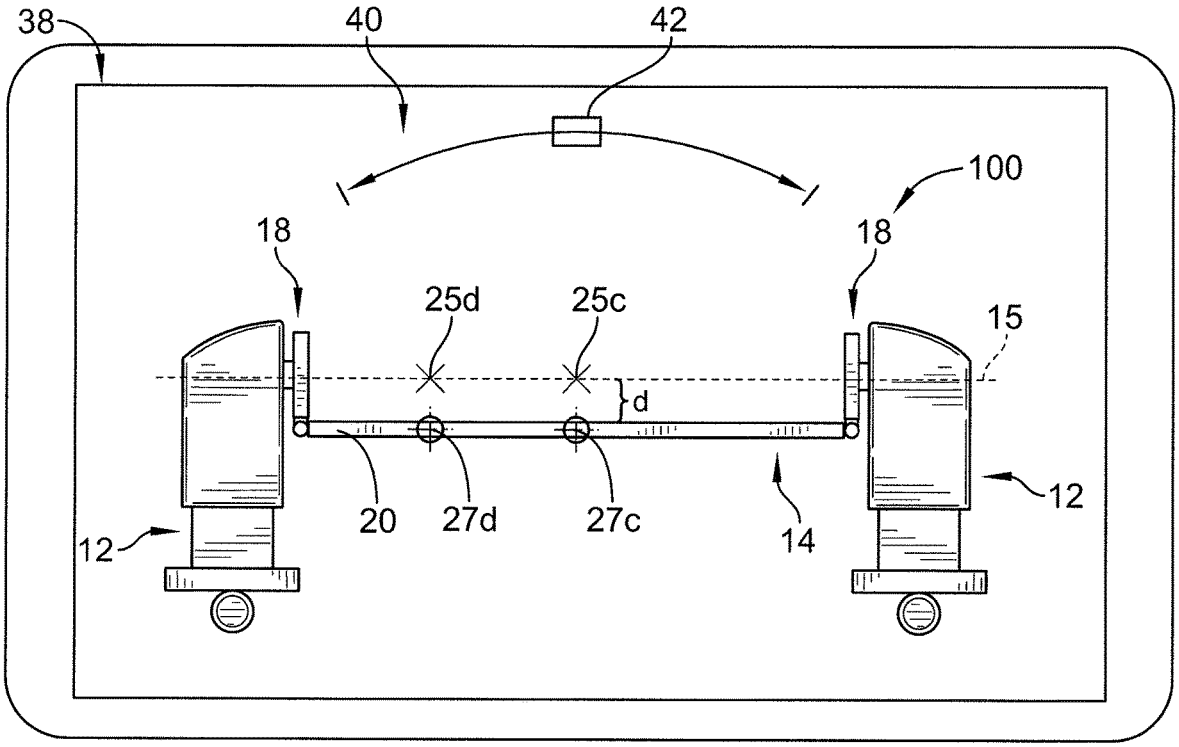
FIG. 7 is a depiction of the graphic user interface of the patient support of FIGS. 1-6 showing that the graphic user interface includes a display illustrating an image of the patient support including indication of the pivot point location and including an adjustment tool for adjusting the longitudinal angle of the support top via the graphic user interface.
Figure 8:
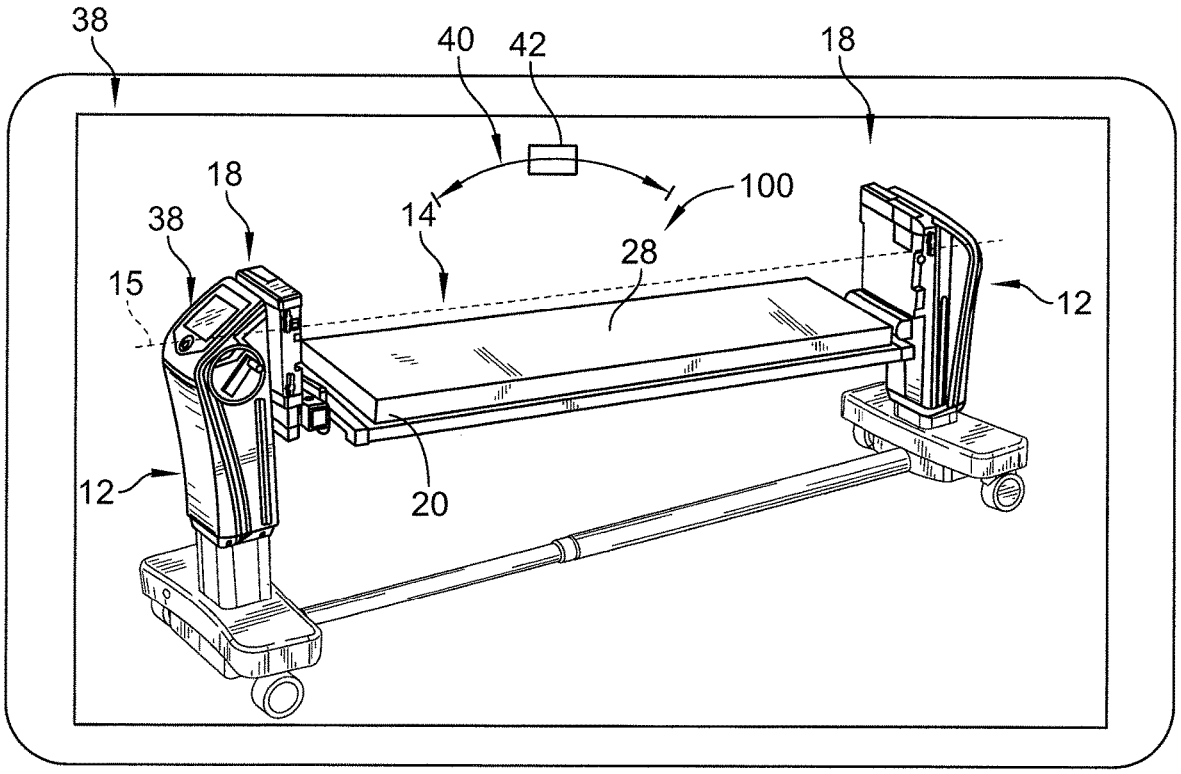
FIG. 8 is another depiction of the graphic user interface of the patient support of FIGS. 1-6 showing that the display illustrates a 3-dimensional image of the patient support including indication of the pivot point location and including an adjustment tool for adjusting the longitudinal angle of the support top via the graphic user interface.

Referring to FIG. 7, the GUI 38 illustratively displays a side view representation 100 of the patient support 10. The GUI 38 illustratively presents the pivot point 25 and may also display the indication 27. The user can assign the pivot point 25 location by touching the corresponding location on the GUI 38. For example, if the presently assigned pivot point is defined as point 25*c*, the user can touch the GUI 38 at the location of the new pivot point 25*d* to define the new location, and to remove the representation on the GUI 38 of the pivot point 25*c* and the corresponding indication 27*c*. The Trendelenburg angle of the support top 14 about the pivot point 25 is illustratively adjustable on the GUI 38 by a slider bar 40. By dragging a slider 42 of the slider bar 40, the user can actively adjust the Trendelenburg angle of the support top 14 about the pivot point 25 by corresponding amount. In some embodiments, in addition or in the alternative to defining the distance d by touching the GUI 38, the user may navigate the GUI 38 to an input screen to input the distance d by numeral input. As shown in FIG. 8, in some embodiments, the GUI 38 may display the representation 100 in a similar manner as in FIG. 7 but in a 3-dimensional view. In some embodiments, adjustment of the parameters of the patient support 10 may be performed on the GUI 38 by any suitable interface manner.

Figure 9:
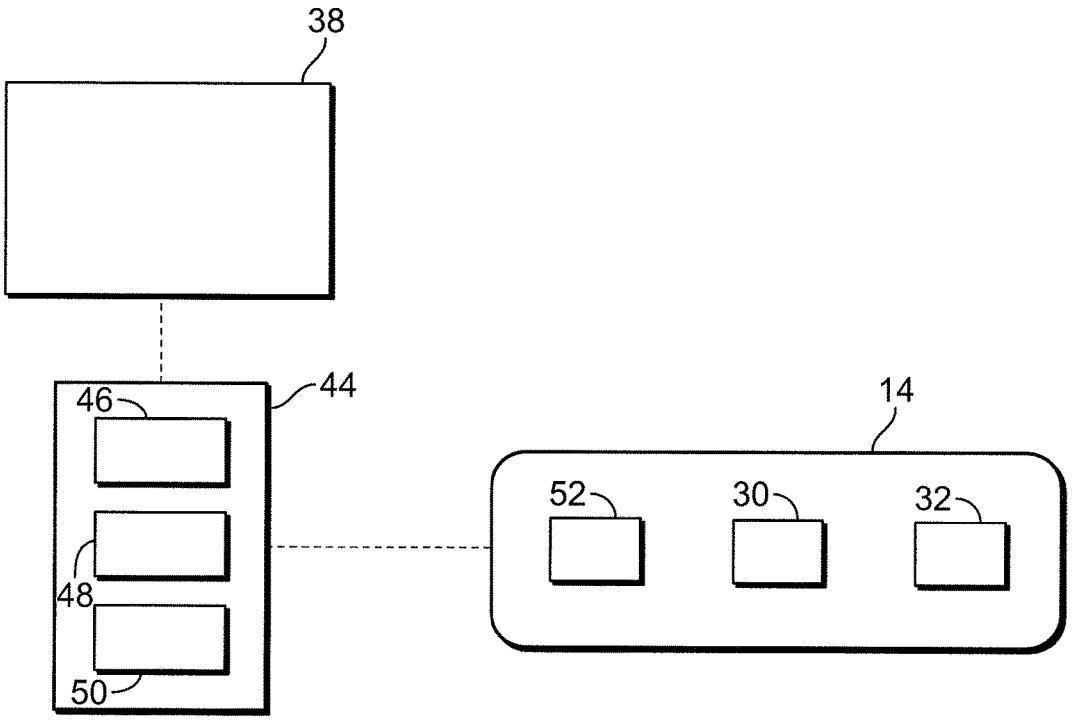
FIG. 9 is a diagram of a control arrangement of the patient support of FIGS. 1-8 showing that the graphic user interface controller which communicates with the patient support top to perform related operation.

As shown in FIG. 9, a control diagram of the GUI 38 is shown. The GUI 38 is arranged in communication with a controller 44 of the patient support 10 adapted to conduct patient support operations. The controller 44 includes a processor 46 for executing instructions stored in a memory device 48 according to inputs from the user as appropriate to control and adjust the patient support 10. The controller 44 includes communications circuitry 50 for communicating with the GUI 38 and other portions 52 of the patient support 10, including sensors and actuators for adjusting the position of the support top 14.

The controller 44 is arranged in communication with the support top 14. The controller 44 communicates with the input 32 to receive user input of the desired location for the pivot point 25 and communicates with the indicator 30 to illuminate the portion of the indicator corresponding with the assigned pivot point location. Other portions 52 of the patient support 10 for adjusting the position of the support top 14 are represented as part of the support top 14 but may include features outside the support top 14, for example but without limitation, those sensors and actuators of the tower bases 12.

Figure 10:
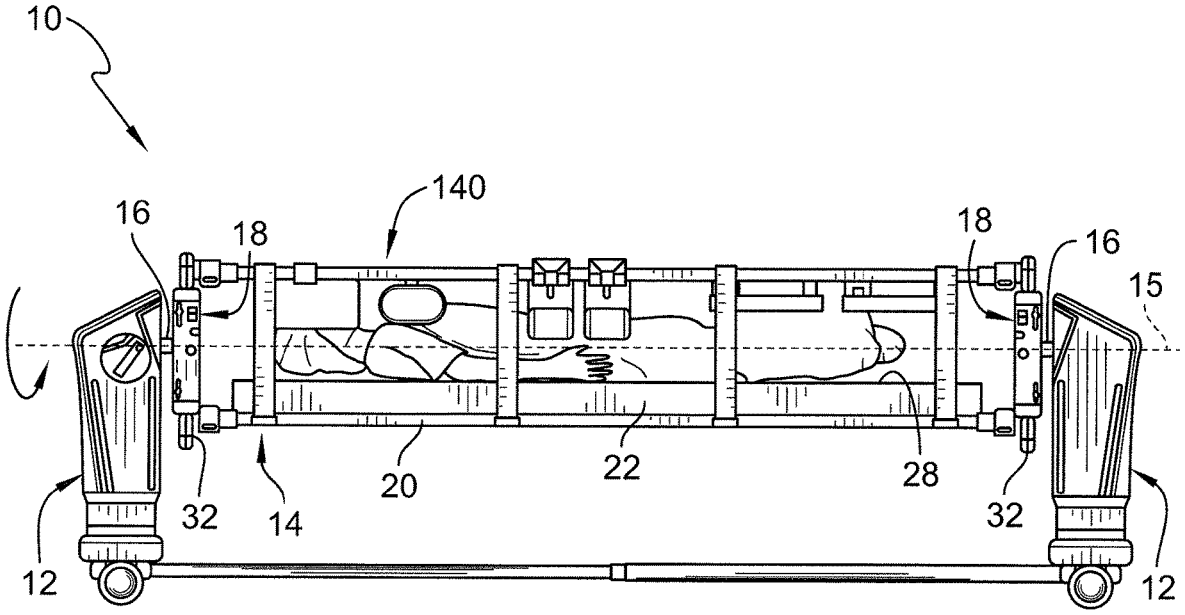
FIG. 10 is an elevation view of the patient support of FIGS. 1-9 having an additional prone support top for performing patient flip rotation.

As shown in FIG. 10, the patient support 10 is illustratively embodied as a versatile patient support capable of having multiple support tops attached to perform flip rotation and other patient positioning functions. For example, in addition to the exemplary supine support top 14, a prone support top 140 is secured with the connection assemblies 18 to engage the patient's anterior for flipping the patient into the prone position. The prone support top 140 illustratively includes prone specific padding. Accordingly, the patient support 10 may have all suitable adjustment features and degrees of freedom of other patient support devices, in additional to those expressly and/or implicitly disclosed herein.

Many complex surgical procedures, such as spine procedures, are performed on two-column table. Two-column tables may allow for the caregivers to manipulate the height of the patient platform, the tilt angle (left and right), and the Trendelenburg angle. Some tables may allow all three dimensions to be adjusted both before and during a procedure.

Spinal surgery can take place at any level along the spine, often in one or more major areas including the cervical, thoracic, and lumbar regions. As such, the surgical site of the patient varies dramatically with respect to the length of the table. For example, the surgical site for cervical procedures is closer to the head end of the table, whereas the surgical site for lumbar procedures is closer to the middle of the table. Most often, this variance in surgical site with respect to the table is of little or no consequence. However, if a surgeon is to perform an intra-operative Trendelenburg angle adjustment and the surgical site is not in the middle of the table, the Trendelenburg adjustment can result in an undesirable change in height of the surgical site. This is because the pivot point for trending the patient platform is fixed in the middle of the table (between the head and foot end). Consequently, a member of the clinical staff needs to perform a secondary height adjustment of the table to return the surgical site to the same height or a similarly desirable height with respect to the surgeon. Providing flexibility in assigning the pivot point for Trendelenburg angle adjustment can provide the surgeon the ability to intraoperatively set the pivot point for trending the patient, obviating the need for a secondary height adjustment. An indicator may be included to communicate the current location of the pivot point.

The present disclosure includes devices, systems, and method for patient platforms—for example, supine, prone, or lateral support tops—that include a soft potentiometer and a strip of individually addressable LEDs. The LEDs may run in parallel with the potentiometer in a channel that extending the length of the side rail of the patient platform. The profile of the channel can allow for predicate pads and top accessories to be attached the side rail. Additionally, the channel can allow the soft potentiometer to be activated by a finger press and the LEDs to be seen by the user. In some embodiments, a battery may provide power for the disclosed functions and may reside in the support top, and/or the top may connect to the power supply of the table, and/or may connect to a wall outlet and/or other power source. Communication between the support top and patient support may be wireless (e.g., Wifi, Bluetooth, nfc, etc.) and/or through a wired connection.

The devices, system, and methods within the present disclosure may include: 1) The user pressing and holding on the soft potentiometer located on the side rail of the patient platform for pre-defined amount of time (e.g., 2 seconds); 2) The new pivot point position being captured and relayed to the table via software and/or hardware; 3) The pivot point position being indicated to the user by an illuminated region of LEDs on the rail. Features of the present disclosure allow these elements to take place through a sterile drape so that the surgeon (and/or other caregiver) doesn't have to break the sterile field, i.e. the soft potentiometer can be activated when draped and the LEDs are bright enough to shine through the drape. The devices, systems, and methods of the present disclosure can provide the surgeon greater control over the position of the patient. Specifically, it can allow the surgeon to retain an optimal, ergonomic, surgical site position irrespective of Trendelenburg adjustments.

Although certain illustrative embodiments have been described in detail above, variations and modifications exist within the scope and spirit of this disclosure as described and as defined in the following claims.

We claim:

1. A patient support for supporting a patient, comprising:

at least one patient top for supporting a patient's body above the floor, the at least one patient top extending longitudinally for a length, and at least one end support coupled with the patient top to support the patient top for selective adjustment of a longitudinal angle of the at least one patient top relative to a defined pivot point, wherein the defined pivot point is selectively assignable to a first predefined location along the longitudinal length of the at least one patient top and is selectively assignable to a second predefined location along the longitudinal length of the at least one patient top, the second predefined location being different than the first predefined location, wherein rotational movement of the at least one patient top is conducted about the defined pivot point as a center of rotation, corresponding to the presently assigned first or second predefined location, during adjustment of the longitudinal angle of the at least one patient top.

2. The patient support of claim 1, wherein the defined pivot point is selectively assignable to correspond with a first assignment, as the first predefined location, at the longitudinal center of the at least one patient top and to correspond with a second assignment, as the second predefined location, off-center from the longitudinal center of the at least one patient top.

3. The patient support of claim 1, wherein the defined pivot point is offset from the at least one patient top by a predetermined distance for accommodating a surgical site of a patient's body as the center of rotation of the patient support.

4. The patient support of claim 1, further comprising a pivot interface for receiving user assignment of the defined pivot point along the length of the patient top.

5. The patient support of claim 4, wherein the pivot interface includes at least one sensor arranged to receive user activation to assign the defined pivot point along the length of the patient top.

6. The patient support of claim 5, wherein the at least one sensor includes a potentiometer extending along the length of the patient top for receiving user contact at an desired position to assign the defined pivot point along the length of the patient top.

7. The patient support of claim 4, wherein the at least one patient top includes a frame including at least one side rail extending longitudinally, and a track adjacent the frame for mounting of the pivot interface.

8. The patient support of claim 7, wherein the track defines a channel for housing at least one sensor for user activation to assign the defined pivot point along the length of the patient top.

9. The patient support of claim 8, wherein the channel is open outwardly away from the frame to receive user activation.

10. The patient support of claim 1, further comprising a graphical user interface configured to receive user activation to assign the defined pivot point.

11. The patient support of claim 10, wherein an alert system includes a graphical depiction presented on the graphical user interface of the patient top having a graphical indication of the present assignment of the defined pivot point.

12. The patient support of claim 11, wherein the graphical depiction of the present assignment of the defined pivot point is presented on the graphical user interface according to user activation of at least one of the graphical user interface and a pivot interface for receiving user assignment of the defined pivot point along the length of the patient top.

13. The patient support of claim 12, wherein the pivot interface includes at least one sensor having a potentiometer extending along the length of the patient top for receiving user contact at an desired position to assign the defined pivot point.

14. A patient support for supporting a patient, comprising:

at least one patient top for supporting a patient's body above the floor, the at least one patient top extending longitudinally for a length, at least one end support coupled with the patient top to support the patient top for selective adjustment of a longitudinal angle of the at least one patient top relative to a defined pivot point, wherein the defined pivot point is selectively assignable along the length of the at least one patient top, and a pivot interface for receiving user assignment of the defined pivot point along the length of the patient top, wherein the pivot interface includes at least one sensor arranged to receive user activation to assign the defined pivot point along the length of the patient top, wherein the at least one sensor includes a potentiometer extending along the length of the patient top for receiving user contact at an desired position to assign the defined pivot point along the length of the patient top.

15. The patient support of claim 14, further comprising an alert system for indicating the present assignment of the defined pivot point, wherein the alert system includes a visual indicator that displays a marking at the present assignment of the defined pivot point along the length of the patient top.

16. A patient support for supporting a patient, comprising:

at least one patient top for supporting a patient's body above the floor, the at least one patient top extending longitudinally for a length, at least one end support coupled with the patient top to support the patient top for selective adjustment of a longitudinal angle of the at least one patient top relative to a defined pivot point, wherein the defined pivot point is selectively assignable along the length of the at least one patient top, a graphical user interface configured to receive user activation to assign the defined pivot point, an alert system for indicating the present assignment of the defined pivot point, wherein the alert system includes a graphical depiction presented on the graphical user interface of the patient top having a graphical indication of the present assignment of the defined pivot point, wherein the graphical depiction of the present assignment of the defined pivot point is presented on the graphical user interface according to user activation of at least one of the graphical user interface, and a pivot interface for receiving user assignment of the defined pivot point along the length of the patient top, wherein the pivot interface includes at least one sensor having a potentiometer extending along the length of the patient top for receiving user contact at an desired position to assign the defined pivot point.

17. The patient support of claim 16, wherein the alert system includes an LED strip arranged to illuminate a portion of the LED strip as the marking at the defined pivot point along the length of the patient top.

18. A patient support for supporting a patient, comprising:

at least one patient top for supporting a patient's body above the floor, the at least one patient top extending longitudinally for a length, at least one end support coupled with the patient top to support the patient top for selective adjustment of a longitudinal angle of the at least one patient top relative to a defined pivot point, wherein the defined pivot point is selectively assignable along the length of the at least one patient top, a graphical user interface configured to receive user activation to assign the defined pivot point, an alert system for indicating the present assignment of the defined pivot point, wherein the alert system includes a visual indicator that displays a marking at the present assignment of the defined pivot point along the length of the patient top, wherein the visual indicator includes an LED strip arranged to illuminate a portion of the LED strip as the marking at the defined pivot point along the length of the patient top.

19. The patient support of claim 17, wherein a graphical depiction is presented on the graphical user interface of the patient top having a graphical indication of the present assignment of the defined pivot point.

20. The patient support of claim 1, further comprising an alert system for indicating the present assignment of the defined pivot point along the length of the patient top, wherein the alert system includes a visual indicator displaying a marking at the defined pivot point along the length of the patient top.

21. The patient support of claim 20, wherein the visual indicator includes an LED strip arranged to illuminate a portion of the LED strip as the marking at the defined pivot point along the length of the patient top.

22. The patient support of claim 1, wherein the define pivot point comprises a selected point to remain stationary under selective longitudinal tilting of the patient support top.

* * * * *